US008991686B2

(12) United States Patent
Schultz

(10) Patent No.: US 8,991,686 B2
(45) Date of Patent: Mar. 31, 2015

(54) EYE SHIELD LENS DISPENSER TRAY

(71) Applicant: Menasha Corporation, Neenah, WI (US)

(72) Inventor: Bradly Thomas Schultz, Greenville, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 14/264,224

(22) Filed: Apr. 29, 2014

(65) Prior Publication Data

US 2014/0319204 A1 Oct. 30, 2014

Related U.S. Application Data

(60) Provisional application No. 61/817,411, filed on Apr. 30, 2013.

(51) Int. Cl.
*B65D 1/22* (2006.01)

(52) U.S. Cl.
CPC ..... *B65D 1/225* (2013.01)
USPC ..... 229/122; 220/62

(58) Field of Classification Search
USPC ..... 229/100, 241, 243, 244
See application file for complete search history.

(56) References Cited

U.S. PATENT DOCUMENTS 4,946,042 A * 8/1990 Ferreri et al. ..... 229/241
6,510,982 B2 * 1/2003 White et al. ..... 229/235
8,328,079 B2 * 12/2012 Kohler ..... 229/244

* cited by examiner

*Primary Examiner* — Christopher Demeree
(74) *Attorney, Agent, or Firm* — Nixon Peabody LLP

(57) ABSTRACT

The present invention provides a dispenser tray for eye shield lenses made from a single blank of material. The dispenser tray and blank each include a top panel, a front panel, a first side panel, a second side panel and a bottom panel.

16 Claims, 2 Drawing Sheets

EYE SHIELD LENS DISPENSER TRAY

CROSS-REFERENCE TO RELATED APPLICATIONS

The present application claims the benefit of U.S. Provisional Application No. 61/817,411, filed Apr. 30, 2013, the contents of which are incorporated herein by reference.

FEDERALLY SPONSORED RESEARCH OR DEVELOPMENT

N/A

TECHNICAL FIELD

The present invention generally relates to a dispenser for lenses for eye shields. The eye shields can be used in connection with medical, dental, or other applications.

BACKGROUND OF THE INVENTION

Healthcare professionals often use disposable eye shields to prevent splatter of bodily fluids such as spittle and blood from entering the eyes to prevent potential infections. Healthcare professionals need to be able to have quick and ready access to such eye shields. Often, the lenses are stored separately from the frames. The present invention provides storage and dispensing access to eye shield lenses.

SUMMARY OF THE INVENTION

The present invention provides a dispenser tray for eye shield lenses made from a single blank of material. A blank includes a top panel and a front panel attached to the top panel along a first fold line. The front panel includes at least one edge tab at an outer edge and a pair of slots spaced along the first fold line. The front panel also includes first and second tabs attached along second and third fold lines. The blank also includes a first side panel attached to the top panel along a fourth fold line, and a first front flap attached to the first side panel along a fifth fold line and a slot located along the fifth fold line. A first back flap is attached to the first side panel along a sixth fold line. A second back flap is attached to the top panel along a seventh fold line. A first back tab is attached along an eighth fold line to the first back flap. A second side panel is attached to the top panel along a ninth fold line. A third back flap is attached to the second side panel along a tenth fold line. A second front flap is attached to the second side panel along an eleventh fold line. A slot is located along the eleventh fold line.

A bottom panel is attached to the second side panel along a twelfth fold line. A detachable panel is attached to the bottom panel along a thirteenth perforated fold line. The detachable panel includes at its outer edge a first tab attached to the outer edge along a fold line. A fourth back flap is attached along a fourteenth fold line to the bottom panel. A second back tab is attached along a fifteenth fold line to the fourth back flap. A glue panel is attached to the bottom panel along a sixteenth fold line. In another embodiment, the second and third fold lines attaching first and second tabs to the front panel each include a notched portion.

BRIEF DESCRIPTION OF THE DRAWINGS

To understand the present invention, it will now be described by way of example, with reference to the accompanying drawings in which.

DETAILED DESCRIPTION

Figure 1:
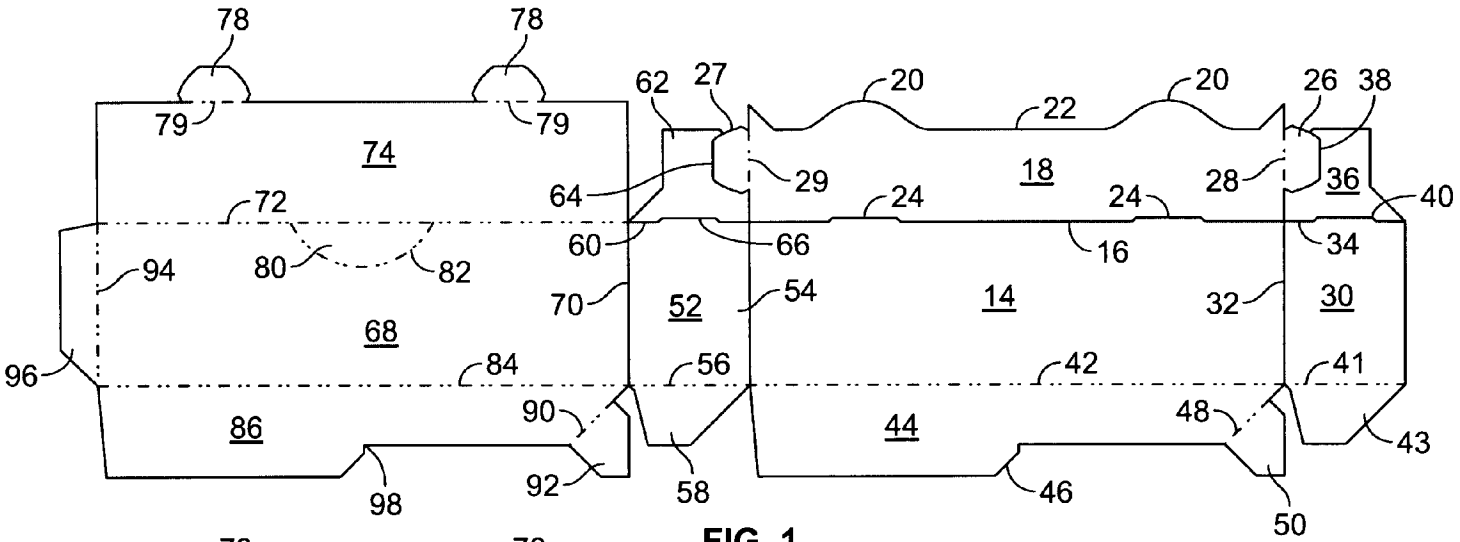
FIG. 1 is a top plan view of a blank for forming a dispenser tray made in accord with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the FIGS., a blank 10 for constructing the dispenser tray 12 of the present invention is provided in FIG. 1. The tray 12 is preferably constructed from a single blank 10 of material such as cardboard or plastic, although, any suitable material may be used. The blank 10 includes a top panel 14. Attached to the top panel 14 along a first fold line 16 is a front panel 18. The front panel 18 includes a pair of edge tabs 20 at an outer edge 22. A pair of slots 24 is spaced along the first fold line 16. The front panel 18 includes first and second tabs 26 and 27 attached along second and third fold lines 28 and 29.

A first side panel 30 is attached to the top panel 14 along a fourth fold line 32. Attached to the first side panel 30 along a fifth fold line 34 is a first front flap 36. First front flap 36 and tab 26 are detachably connected along a first cut line 38. A slot 40 is located along fifth fold line 34. Attached to the first side panel 30 along a sixth fold line 41 is a first back flap 43.

Attached along a seventh fold line 42 to top panel 14 is a second back flap 44. The second back flap 44 includes a stepped portion 46. Attached along an eight fold line 48 to the first back flap 44 is a first back tab 50.

A second side panel 52 is attached along a ninth fold line 54 to the top panel 14. Attached to the second side panel 52 along a tenth fold line 56 is a third back flap 58. Attached to the second side panel 52 along an eleventh fold line 60 is a second front flap 62. Second front flap 62 and second tab 27 are detachably connected along a second cut line 64. A slot 66 is located along the eleventh fold line 60.

A bottom panel 68 is attached along a twelfth fold line 70 to the second side panel 52. Attached to the bottom panel 68 along a thirteenth perforated fold line 72 is a detachable panel 74. The detachable panel 74 includes at its outer edge 76 a pair of tabs 78 that cooperate with slots 24 as will be described below. Tabs 78 are attached to the outer edge 76 along fold lines 79. The bottom panel 68 also includes a cutout 80 formed by perforated line 82.

Attached along a fourteenth fold line 84 to bottom panel 68 is a fourth back flap 86. The fourth back flap 86 includes a stepped portion 88 that cooperates with stepped portion 46 to form the back of the dispenser tray 12. Attached along a fifteenth fold line 90 to the fourth back flap 86 is a second back tab 92. Attached to the bottom panel 68 along a sixteenth fold line 94 is a glue panel 96.

Figure 5:
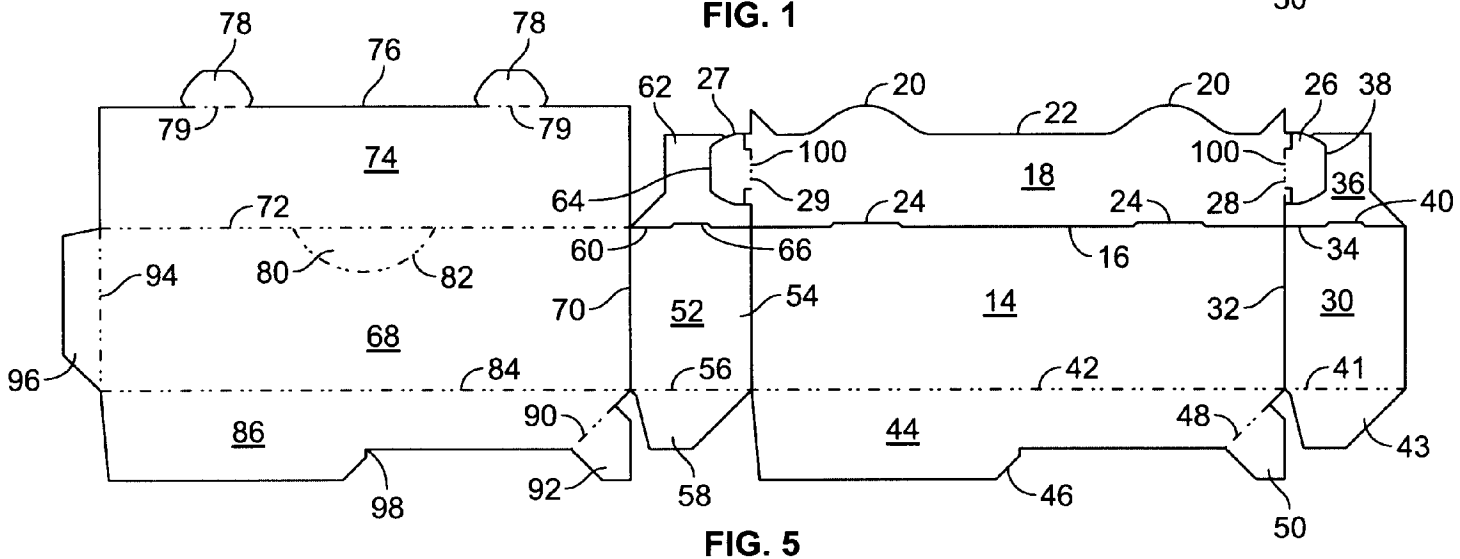
FIG. 5 is a top plan view of a blank for forming a dispenser tray made in accord with the present invention.

The embodiment shown in FIG. 5 is very similar to that of FIG. 1. However, in FIG. 5, tabs 26 and 27 are slightly small than the embodiment of FIG. 1. Moreover, the second and third fold lines 28 and 29 attaching first and second tabs 26 and 27 to the front panel 18 each include a notched portion 100.

To construct the dispenser tray 12, the first side panel 30, top panel 14, second side panel 52, and bottom panel 68 are folded inward along fold lines 32, 54, and 70. The first tab 26 and second tab 27 and are separated along cut lines 38 and 64, respectively. First tab 26 is folded inwardly along fold line 28 and second tab 27 is folded inwardly along fold line 29. First front flap 36 is folded inwardly along fold line 34. Second front flap 62 is folded inwardly along fold line 60. Front panel 18 is folded inwardly along fold line 16. Detachable panel 74 is folded inwardly along fold line 72. Second and fourth back flaps 44 and 86 are folded inwardly along fold lines 42 and 84. First and third back flaps 43 and 58 are folded inwardly along fold lines 41 and 56. First and second back tabs 50 and 92 are folded inwardly along fold lines 48 and 90. Glue panel 96 is folded inwardly along fold line 94.

The first, second, third, and fourth back flaps 43, 44, 58 and 86, and first and second back tabs 50 and 92 auto-erect to form a back wall 98 of die tray 12. The second and fourth back flaps 44 and 86 meet such that the stepped portions 46 and 88 intersect. First and second back tabs 50 and 92 are glued to the inner surfaces of the second and fourth back flaps 44 and 86. First and third back flaps 43 and 58 are glued to the inner surface of the first and second back tabs 50 and 92.

Figure 2:
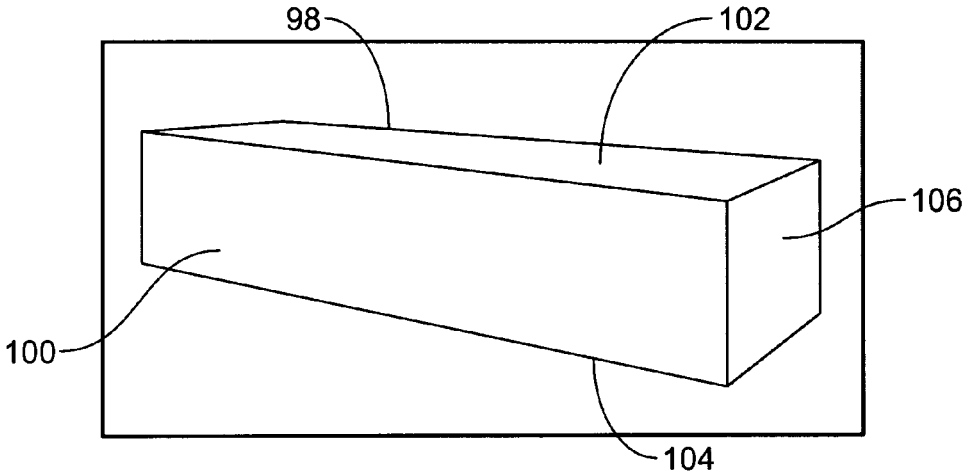
FIG. 2 is a perspective rear view of a dispenser tray in accord with the present invention.

First and second front flaps 36 and 62 are folded inwardly until substantially perpendicular to top panel 14, as is front panel 18. Tab 26 is inserted into slot 40. Tab 27 is inserted into slot 66. Tabs 78 are inserted into slots 24. Glue panel 96 is glued to the inner surface of the first side panel 30. This is a closed position for the tray 12 as shown in FIG. 2. When constructed the dispenser tray 12 includes the back wall 98 described above, a removable front wall 100 formed by the detachable panel 74, a top wall 102 formed by top panel 14, a bottom wall 104 formed by the bottom panel 68, and side walls 106 formed by first and second side panels 30 and 52.

Figure 3:
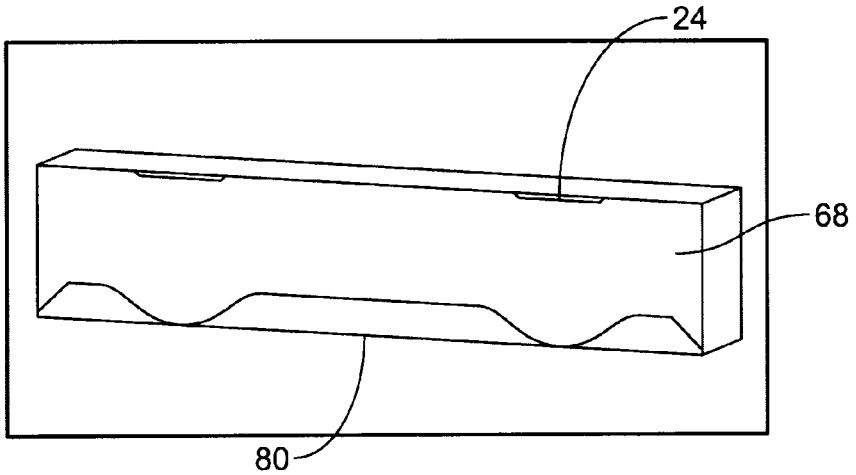
FIG. 3 is a perspective front view of a dispenser tray in accord with the present invention.
Figure 4:
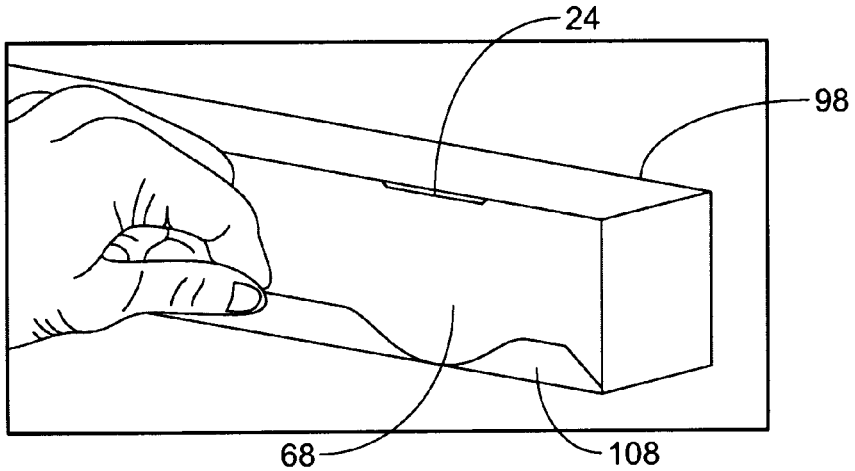
FIG. 4 is a perspective view showing the frames being dispensed from a dispenser view in accord with the present invention.

For use, the detachable panel 74 is removed along perforations 72 and 82, and the tabs 78 removed from slots 24. The dispenser tray 12 is shown in FIG. 3 with the detachable panel 74 removed, exposing the front panel 18, and creating cutout 80 in the bottom panel 68. Cutout 80 allows better access to lenses 108 within the tray 12 (FIG. 4). Tabs 20 retain the lenses within the tray 12 until removed by the user. The tray 12 can be mounted on a wall or in a holder (not shown) such that the tray 12 can be easily replaced when the supply of glasses or frames therein is exhausted.

While the specific embodiments have been illustrated and described, numerous modifications come to mind without significantly departing from the spirit of the invention, and the scope of protection is only limited by the scope of the accompanying Claims.

What is claimed is:

1. A blank for forming a dispenser tray comprising:

a top panel;

a front panel attached to the top panel along a first fold line, the front panel including at least one edge tab at an outer edge, a pair of slots spaced along the first fold line, and first and second tabs attached along second and third fold lines;

a first side panel attached to the top panel along a fourth fold line;

a first front flap attached to the first side panel along a fifth fold line and a slot located along the fifth fold line;

a first back flap attached to the first side panel along a sixth fold line;

a second back flap attached to the top panel along a seventh fold line;

a first back tab attached along an eighth fold line to the first back flap;

a second side panel attached to the top panel along a ninth fold line;

a third back flap attached to the second side panel along a tenth fold line;

a second front flap attached to the second side panel along an eleventh fold line, and a slot located along the eleventh fold line;

a bottom panel attached to the second side panel along a twelfth fold line;

a detachable panel attached to the bottom panel along a thirteenth perforated fold line, the detachable panel including at its outer edge a first tab attached to the outer edge along a fold line;

a fourth back flap attached along a fourteenth fold line to the bottom panel;

a second back tab attached along a fifteenth fold line to the fourth back flap; and a glue panel attached to the bottom panel along a sixteenth fold line.

2. The blank of claim 1 wherein the bottom panel includes a cutout formed by a perforated line.

3. The blank of claim 2 wherein the cutout is semi-circular and is located near the center of an outer edge of the bottom panel.

4. The blank of claim 1 wherein the second and third fold lines each include a notched portion.

5. The blank of claim 1 wherein the blank is made from a cardboard material.

6. The blank of claim 1 wherein the first front flap and first tab are detachable connected along a first cut line, and the second front flap anal second tab are detachably connected along a second cut line.

7. The blank of claim 1 wherein the second back flap and fourth back flap each include a stepped portion.

8. The blank of claim 1 wherein the detachable panel includes at its outer edge a second tab attached to the outer edge along a fold line.

9. A dispenser tray made from a single blank of material, the tray including a removable front wall;

a back wall;

a top wall;

a bottom wall;

a pair of side walls;

wherein the single blank of material includes;

a top panel;

a front panel attached to the top panel along a first fold line, the front panel including at least one edge tab at an outer edge, a first slot spaced along the first fold line, and a first and second tabs attached along second and third fold lines;

a first side panel attached to the top panel along a fourth fold line;

a first front flap attached to the first side panel along a fifth fold line, and a slot located along the fifth fold line;

a first back flap attached to the first side panel along a sixth fold line;

a second back flap attached to the top panel along a seventh fold line;

a first back tab attached along an eighth fold line to the first back flap;

a second side panel attached to the top panel along a ninth fold line;

a third back flap attached to the second side panel along a tenth fold line;

a second front flap attached to the second side panel along an eleventh fold line, and a slot located along the eleventh fold line;

a bottom panel attached to the second side panel along a twelfth fold line, and including a cutout formed by a perforated line;

a detachable panel attached to the bottom panel along a thirteenth perforated fold line, the detachable panel including at its outer edge a first tab attached to the outer edge along a fold line;

a fourth back flap attached along a fourteenth fold line to the bottom panel;

a second back tab attached along a fifteenth fold line to the fourth back flap; and a glue panel attached to the bottom panel along a sixteenth fold line.

10. The tray of claim 9 wherein the bottom panel includes a cutout formed by a perforated Line.

11. The tray of claim 10 wherein the cutout is semi-circular and is located near the center of an outer edge of the bottom panel.

12. The tray of claim 9 wherein the second and third fold lines each include a notched portion.

13. The tray of claim 9 wherein the second and third fold lines each include a notched portion.

14. The tray of claim 9 wherein the blank is made from a cardboard material.

15. The tray of claim 9 wherein the first front flap and first tab are detachable connected along a first cut line, and the second front flap and second tab are detachably connected along a second cut line.

16. The tray of claim 9 wherein the second back flap and fourth back flap each include a stepped portion.

* * * * *

UNITED STATES PATENT AND TRADEMARK OFFICE

CERTIFICATE OF CORRECTION

PATENT NO. : 8,991,686 B2
APPLICATION NO. : 14/264224
DATED : March 31, 2015
INVENTOR(S) : Bradly Thomas Schultz It is certified that error appears in the above-identified patent and that said Letters Patent is hereby corrected as shown below:

Claims

In Column 4, line 34, in Claim 6, delete “detachable” and insert --detachably-- therefor;

In Column 4, line 35, in Claim 6, delete “anal” and insert --and-- therefor;

In Column 4, line 49, in Claim 9, delete “includes” and insert --includes:-- therefor;

In Column 6, line 2, in Claim 10, delete “Line.” and insert --line.-- therefor;

In Column 6, line 13, in Claim 15, delete “detachable” and insert --detachably-- therefor.

Signed and Sealed this
Eleventh Day of August, 2015

Michelle K. Lee

Michelle K. Lee
*Director of the United States Patent and Trademark Office*